US009642432B2

(12) United States Patent
Carey

(10) Patent No.: US 9,642,432 B2
(45) Date of Patent: May 9, 2017

(54) BEAUTY BUN

(75) Inventor: Latannia Carey, Port Saint Lucie, FL (US)

(73) Assignee: Latannia Carey, Port Saint Lucie, FL (US)

( * ) Notice: Subject to any disclaimer, the term of this patent is extended or adjusted under 35 U.S.C. 154(b) by 0 days.

(21) Appl. No.: 13/374,485

(22) Filed: Dec. 30, 2011

(65) Prior Publication Data

US 2012/0174942 A1 Jul. 12, 2012

Related U.S. Application Data

(60) Provisional application No. 61/460,393, filed on Jan. 3, 2011.

(51) Int. Cl.
*A45D 8/00* (2006.01)
*A45D 8/34* (2006.01)

(52) U.S. Cl.
CPC ..... *A45D 8/34* (2013.01)

(58) Field of Classification Search
USPC ..... 132/200–201, 273–284, 53–56; 2/410, 2/209.14
See application file for complete search history.

(56) References Cited

U.S. PATENT DOCUMENTS 3,693,637 A * 9/1972 Sidelman ..... 132/55
5,730,161 A * 3/1998 Kohanek ..... 132/273
5,769,101 A * 6/1998 Iwata ..... 132/273
6,047,708 A * 4/2000 Panel et al. ..... 132/273
7,293,566 B2 * 11/2007 Thall ..... 132/274
2002/0056467 A1 * 5/2002 Srivastava ..... 132/273
2007/0221243 A1 * 9/2007 Sonstegard ..... 132/273
2007/0246059 A1 * 10/2007 Jensen ..... 132/273
2008/0072922 A1 * 3/2008 Shidler ..... 132/275
2008/0099036 A1 * 5/2008 Crowley et al. ..... 132/275

OTHER PUBLICATIONS

How-to: Make a Hair Bun with the Sock Method,[online], Mar. 15, 2009 [retrieved on Aug. 23, 2013]. Retrieved from the Internet: URL:>http://icemom.blogspot.com/2009/03/how-to-make-hair-bun-with-sock-method.html<.* web site: http://www.amazon.com/dp/B000N5S016/ref=asc df B000N5S0162422591?smid=AKZ54, Hot Waves Hair Foundation Chignon, 2.5 "tall, Mar. 22, 2013.

(Continued)

*Primary Examiner* — Todd Manahan
*Assistant Examiner* — Brianne Kalach

(57) ABSTRACT

A hair collection center structure encompass a nylon halo cylinder for allowing a hair bundle to pass through the center. The nylon cylinder is tightly rolled with hair elastic connected to the nylon to extend letting the rubber band snap around the halo cylinder keeping the hair in place. The nylon cylinder is formed by placing a hole at the end of the nylon and tightly rolling it to form a thick circular bun. The thickness and strength which are extremely sufficient for facilitating the beauty bun style by placing the hair in a secure and protected bun. The elastic allows the rubber band length to stretch fixing the hair in a round circular shape, avoiding the need of uncomfortable pins.

8 Claims, 5 Drawing Sheets

(56) References Cited

OTHER PUBLICATIONS web site: http://store.goldenbnmartbeautysupply.com/anhabunwnyme2.html, www.GMShair.com, Annie Hair Bun with button nylon mesh foam 8 1/2", Mar. 22, 2013.
web site: http://storegoldenmartbeautysupply.com/anfohafo31di.html, www.GMBShair.com, Annie Foam Hair Foundation, 3 1/4" diameter thick, Mar. 22, 2013.
web site: http://vi.raptor.ebaydesc.com/ws/eBayISAP.dll?viewItemDesV4&item=120670040589, Donna Creations, Round Firm Foam Foundation, Mar. 22, 2013.
web site: http:/www.amazon.com/S?ie=UTF8&page=1&rh=7%3A3760911%2CP 4% 3ADonna%2, Donna Creations, Round French Roll Black, Mar. 22, 2013.
website: http://www.amazon.com/Bombshell-Large-Donut-Styling-Accessories/dp/B0072CQASK/r, J & D Beauty Products, Bombshell Large Hair Dougnut Hair Styling Accessory, Mar. 22, 2013.
web site: http://www.amazon.com/SODIAL-FORMER-DOUGHNUT-HAIRDRESSING-Diameter, SODIAL, Black Bun Hair Former Doughnut, Doughnut Shaper Ring Styler Hairdressing, Diameter .9 cm, Mar. 22, 2013.

* cited by examiner

BEAUTY BUN

CROSS-REFERENCE TO RELATED APPLICATION

This application claims the benefit of U.S. Provisional Application No. 61/460,393 filed on Jan. 3, 2011, which is incorporated herein by reference in its entirety.

BACKGROUND OF THE INVENTION

1. Field of the Invention

This invention relates commonly to hair styling accessories.

2. Art

A well-liked hair style is a circular rolled bun that bears a resemblance to a halo or a crown. A halo/crown can be done by putting on a convenient hair piece already made, but the hair color should be a preferred match, and hair pins must be used for securing the hair piece. A halo/crown can also be done by covering hair around a styling shape. A typical form comprises a nylon rolled cylinder having free ends. The cylinder is bent to encircle the head generally around the hairline, and the hair is wrapped around the cylinder from the middle direction to the end of the hair. The nylon cylinder will straighten immediately whenever released, so that it is very difficult to use. Further, the hair will not to get caught in the nylon cylinder, so removing the cylinder will not cause hair to be pulled out. Another known hair form is for doing a chignon, which is a small bun worn at the back of the head or the nape of the neck. The chignon form comprises a small nylon loop made by opening the hair around the nylon forming a circular bun. It has a very small opening in the center and the nylon fabric will not snatch and pull hair during removal.

OBJECTS OF THE INVENTION

An object of the present invention is to provide a hair styling form that can be put on without hair pins.

Another object of the present invention is to provide a hair styling form that does not snatch, grab or pull hair.

Further objects of the present invention will become apparent from a consideration of the drawings and ensuing description.

BRIEF SUMMARY OF THE INVENTION

A hair styling form includes a nylon rolled fabric into a circular form. The elastic joins together the rubber band to form a loop large enough to encircle a person's bun. To use, hair is combed down from the head, and the styling form is placed in the middle, either side or the crown of the head. Hair is wrapped around the form to create a halo/crown-shaped hair style.

DETAILED DESCRIPTION OF THE INVENTION

Figure 1:
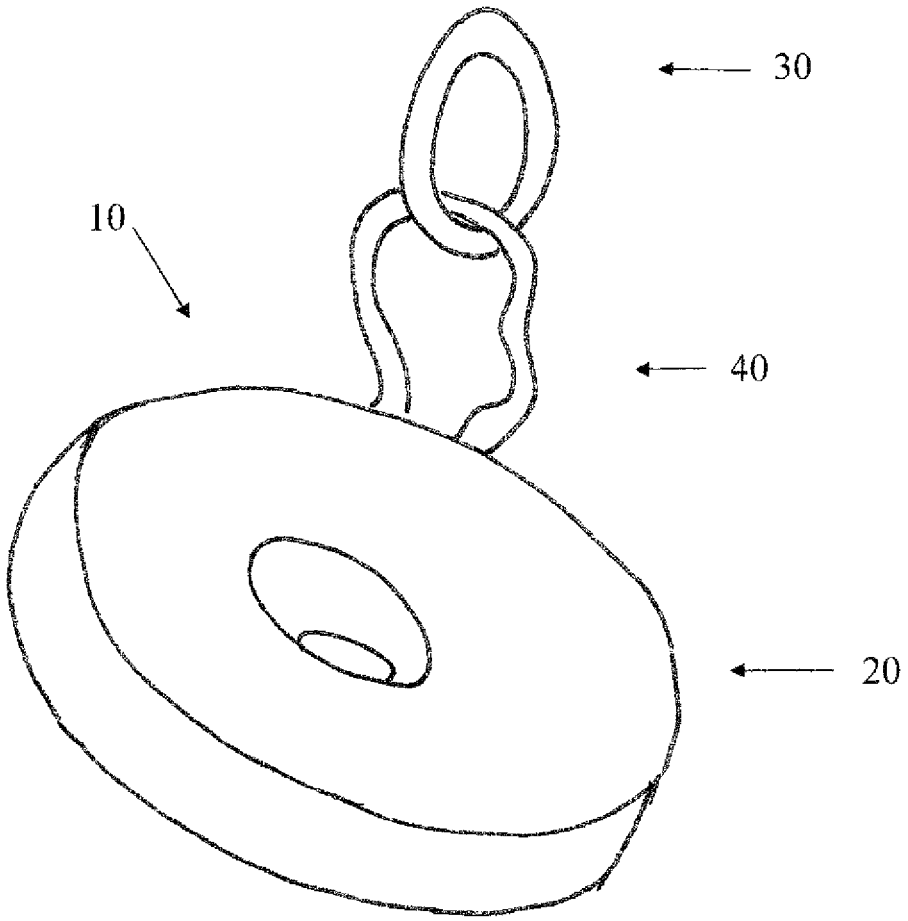
FIG. 1 is a side view of a hair styling device according to an exemplary embodiment.
Figure 2:
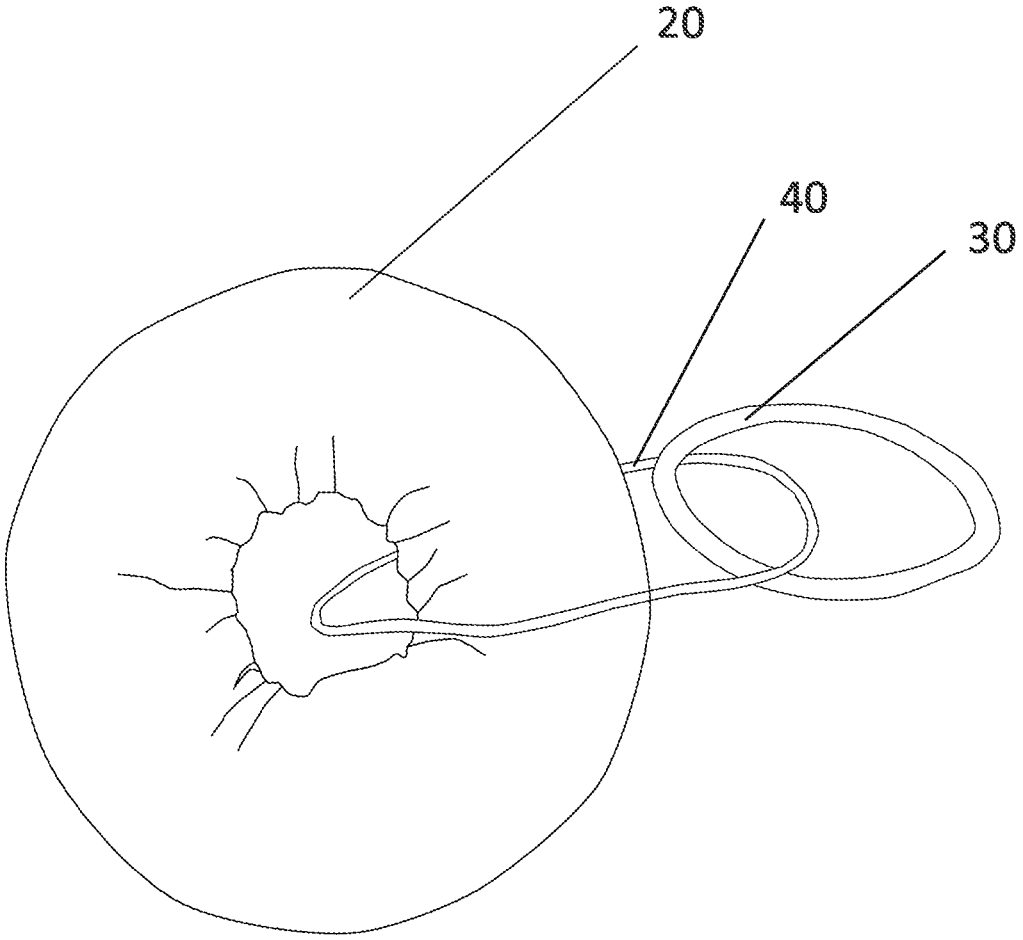
FIG. 2 is a side view of a hair styling device according to an exemplary embodiment.
Figure 3:
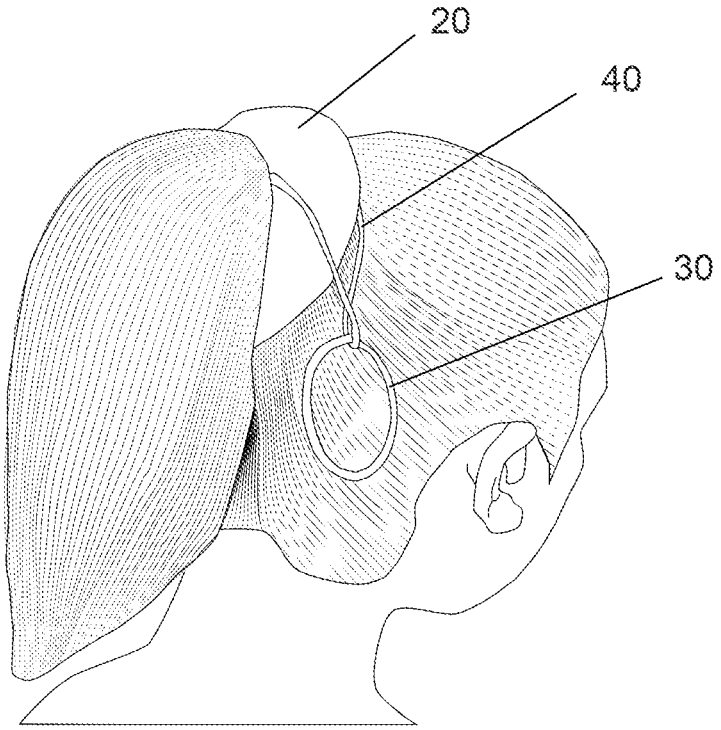
FIG. 3 is a perspective view of a hair styling device according to an exemplary embodiment.
Figure 4:
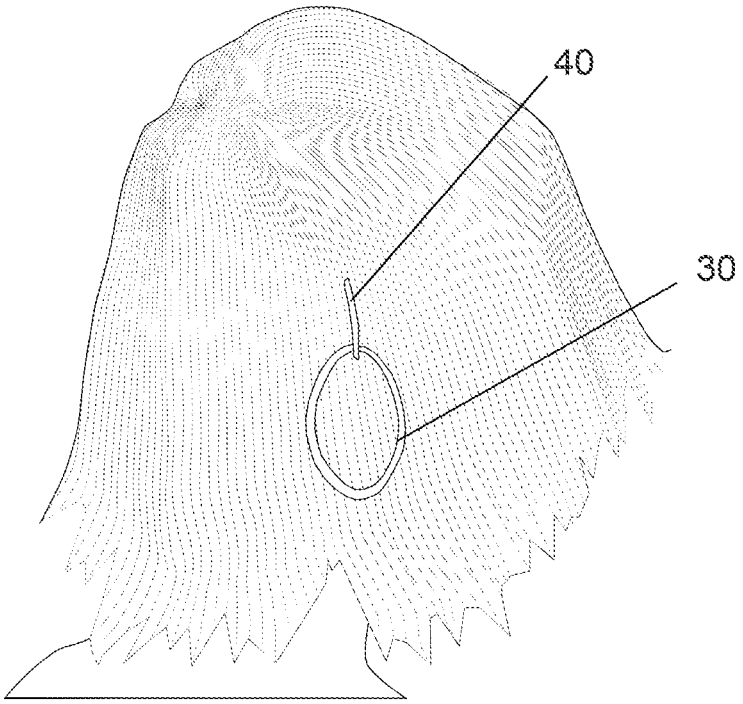
FIG. 4 is a perspective view of a hair styling device according to an exemplary embodiment.
Figure 5:
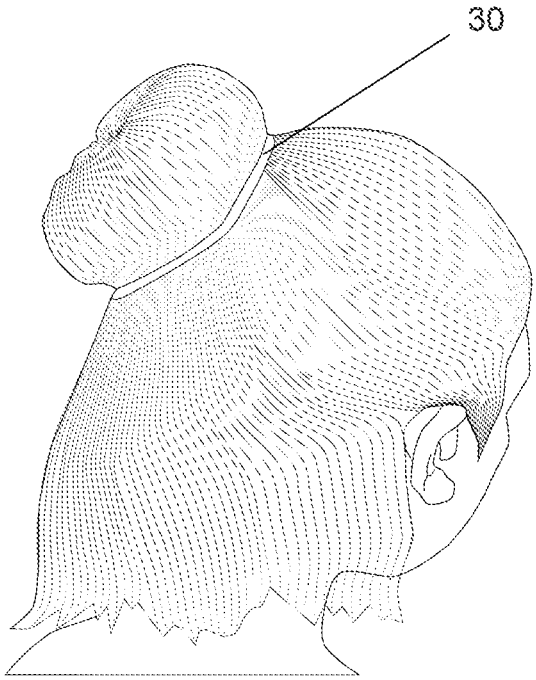
FIG. 5 is a perspective view of a hair styling device according to an exemplary embodiment.
Figure 6:
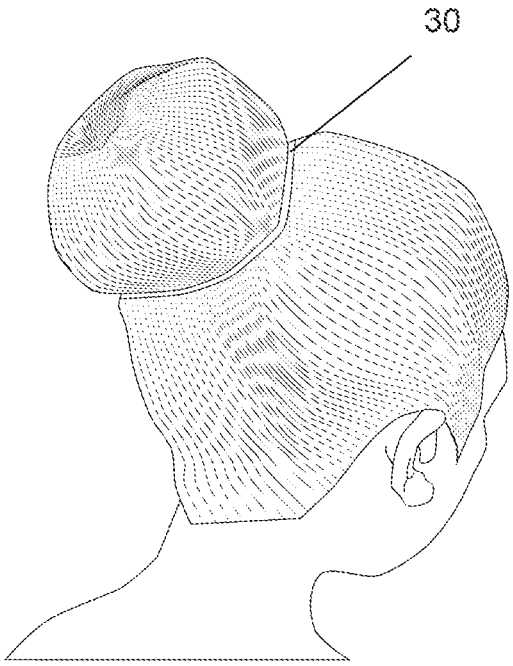
FIG. 6 is a perspective view of a hair styling device according to an exemplary embodiment.
Figure 7:
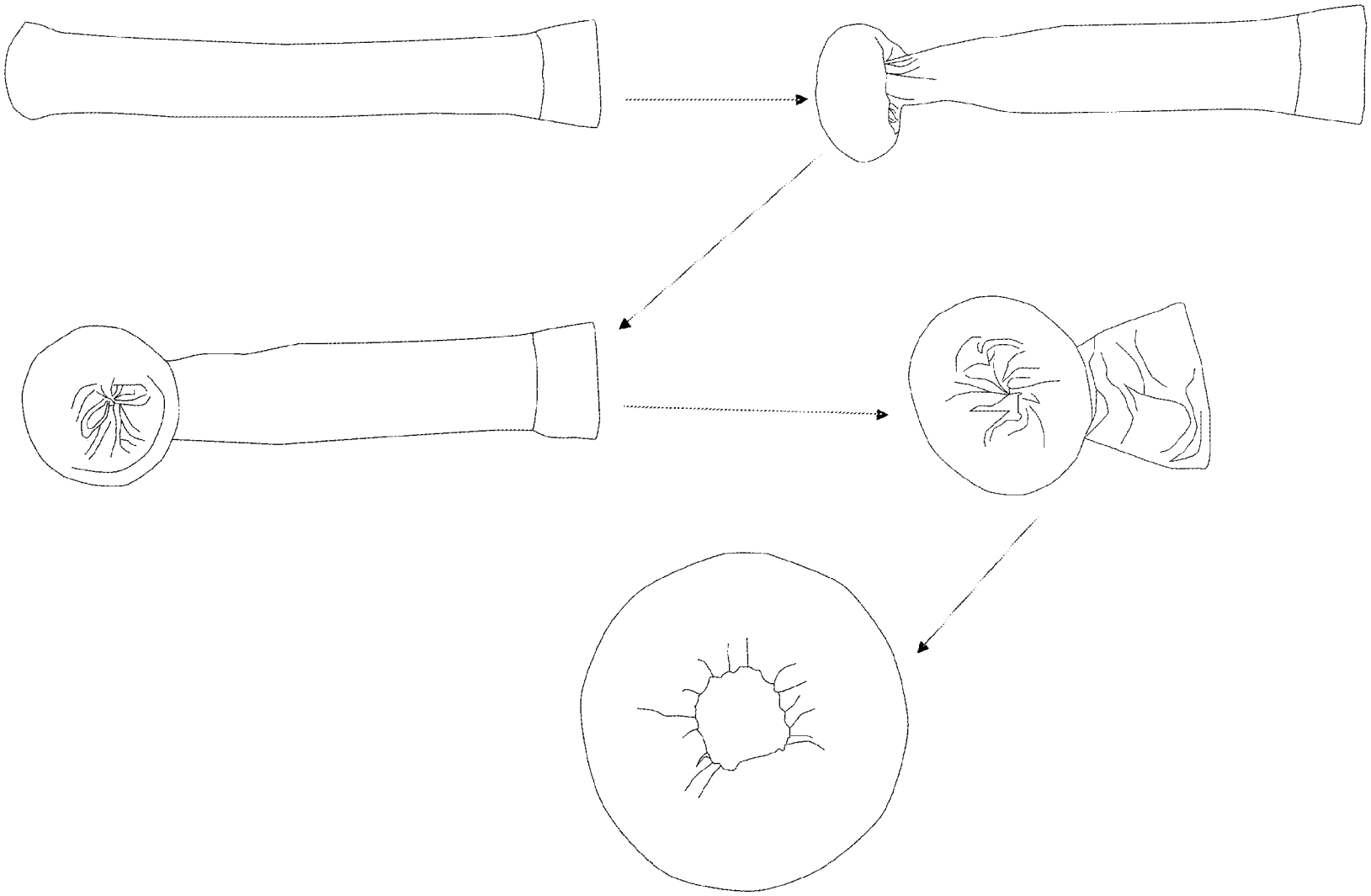
FIG. 7 is a top plan view of a hair styling device according to an exemplary embodiment.

In accordance with a preferred embodiment of the invention shown in FIG. 1, a hair styling device 10 has a support member 20, securing member 30, and connecting member 40. The hair styling device 10 is preferably provided in different colors, such as black, brown, and red, for matching different hair colors.

In one embodiment, the hair styling device 10 has a support member 20 for supporting the hair in a desired style. In one embodiment, the support member 20 resembles the shape of a disc. The support member 20 can have an exterior side and an interior side. The support member 20 allows for the hair to rest against the exterior surface thereby creating a desired hair style. While the support member 20 can have any dimensions that allow for the creation of a hair style, the support member 20 is 1.5" thick and has a diameter of 3.5". In one embodiment, the support member 20 can have an aperture allowing for hair to pass through the support member 20. While the aperture can have any diameter that allows for hair to pass through the support member 20, the aperture is preferably 1" in diameter. The support member 20 can be made of nylon, spandex, or the like.

In one embodiment, the hair styling device 10 has a securing member 30 for allowing the hair to be retained in a desired style. In one embodiment, the securing member 30 has the shape of a ring having a securing aperture for receiving the support member 20. The securing member 30 is made of elastic material allowing for the securing member 30 to stretch thereby increasing the diameter of the securing member 30. The securing member 30 can allow for the hair to be retained in a desired style by securing the hair between the securing member 30 and the support member 20 and/or the hair between the securing member 30 and the base of the pony tail.

In one embodiment, the hair styling device 10 has a connecting member 40 for coupling the securing member 30 to the support member 20, thereby allowing for the securing member 30 to be in close proximity to the support member 20. The connecting member 40 is made of elastic material allowing for the connecting member 40 to stretch thereby allowing for the distance between the support member 20 and securing member 30 to increase while allowing for the support member 20 and the securing member 30 to be coupled. While the connecting member 40 can be stretched to any length that allows for the support member 20 to pass through the securing aperture while coupling the securing member 30 to the support member 20, the connecting member 40 can be preferably stretched to a length of approximately 4". In one embodiment, the connecting member 40 is a ring where the connecting member 40 passes through the aperture of the support member 20 and passes through the securing aperture of the securing member 30.

In one embodiment, the present disclosure allows for a method of using a hair styling device 10. The hair is brushed into a cylinder shape or a pony tail style thereby creating the base portion, the pony tail, and the tips. The pony tail style can be brushed to any location on the head including the top, side, and base. The tips of the pony tail are threaded through the aperture of the support member 20 and the pony tail is pulled through the aperture. The support member 20 is then pushed in a manner than allows for the support member 20 to traverse the remaining section of the pony tail toward the head until the interior side of the support member 20 touches the base portion of the pony tail. The hair that has passed through the aperture is wrapped around the exterior surface of the support member 20. In one embodiment, the hair is radially positioned around the exterior surface of the support member 20. The securing member 30 is then stretched in a manner where the diameter of the securing member 30 is greater than the exterior diameter of the support member 20. The support member 20 and pony tail then pass through the securing aperture and the securing member 30 is allowed to recoil or snap around the hair that has been wrapped around the exterior surface of the support member 20, thereby securing the hair in place. The hair can be secured to the base of the pony tail and/or the support member 20. The interaction between the support member 20 and the hair creates friction thereby preventing the hair from being dislodged between the support member 20 and the securing member 30 and/or the base of the pony tail and the securing member 30. The tips of the hair are then tucked under the support member 20 thereby hiding the tips of the hair from view.

In one embodiment, hair styling device is manufactured by rolling the material into a ring with an aperture. In one embodiment, the circular ring is manufactured by rolling material in the shape of a cylinder upon. For example, the nylon material is rolled upon itself in an outwardly manner where, upon rolling, the interior surface of the cylinder touches the exterior surface of the cylinder and the interior surface of the cylinder is the exterior surface of the rolled material. The rolled tube of material creates a support member 20 with layers of material. In the preferred embodiment, the cylinder or tube of material is approximately 12" long. In one embodiment, where the support member 20 is created using a nylon stocking, the toe section of a nylon stocking is cut thereby creating an opening in the toe section of the stocking allowing for the nylon stocking to be rolled upon itself.

Accordingly, a hair styling device 10 is provided for designing a halo/crown-shaped hair style. It can be positioned without the use of hair pins, and does not snag, grab or pull the hair.

Although the above description are specific, they should not be considered as limitations on the scope of the disclosure, but only as examples of the embodiments. Many alternatives and similarities are possible within the teachings of the disclosure. For example, other fabrics may be used for forming the circular concept. A cotton, foam may be placed between bulon to thicken the device. Styling may be braided in other sizes for encircling different size heads. There may be various sized diameter of the loop. Styling may comprise of different surfaces for additional decorations. The nylon may be made of other suitable materials, such as fabric. Therefore, the scope of the disclosure should be determined by the appended claims and their legal equivalents, not by the examples given.

The present invention relates to hair styling devices, namely devices for forming French knots, buns and the like.

Long hair styles are popular with people of all ages, particularly with women. Because of the popularity of long hair styles, several devices have been invented for styling long hair. Examples include barrettes, hair ties, combs and ornamental hair pins.

Of the hair styling devices that are currently known, there are few devices that exist which are useful for styling long hair into a bun, a French knot, or similar style.

There are soft sponge-like rings that are known. The ring is covered with a fine netting material, which can be used by drawing the hair through the opening in the sponge, wrapping the hair around the ring and securing the hair onto the ring by trapping the hair and the netting material together with hair pins. The rings described above can also be formed from a fabric such as woven nylon covered with a nylon netting. Typically, the rings have an outer diameter of approximately four inches and have an inner diameter of approximately two inches.

There are disadvantages in using a soft ring to form a hair bun. It is difficult to wrap smooth, thick hair around the ring, pin the hair down and have the hair remain in place. It is also quite time consuming to wrap the hair around the ring when the hair is long. When the hair being styled is shorter, it may not be possible to wrap the hair completely around the ring.

There are flexible combs that are known having two ends which can be opened to install the comb around hair, and then closed to form a substantially circular ring. Flexible combs have many sharp, pointed edges which can scrape the scalp. Such a comb is also not particularly useful for styling hair into a bun. The flexible combs described above are primarily intended to be used to form French knots.

There is currently no nylon known hair styling devices easy to wash, which can be used to rapidly and easily form a French knot, bun or similar hair style using the nylon rubber band. It is the quality of this product that stands above the rest for the current market devices.

I claim:

1. A method of using a hair styling device, wherein the hair styling device comprises a ring shaped support member having an aperture, a securing member having an aperture, and a connecting member, whereby a portion of the connecting member passes through the aperture of the support member and a portion of the connecting member passes through the aperture of the securing member, the method comprising the steps of:

creating a pony tail hair style, threading tips of the pony tail through an aperture of a support member, sliding the support member along the pony tail toward a user's head, wrapping a user's hair that has passed through the aperture around an exterior surface of the support member, stretching a securing member wherein a diameter of the securing member is greater than an exterior diameter of the support member, passing the support member and pony tail through a securing aperture, and allowing for the securing member to recoil around the user's hair that has been wrapped around the exterior surface of the support member, whereby the user's hair that wrapped around the exterior surface of the support member is secured in place.

2. A method of claim 1 where support member is slid along the pony tail toward the user's head until the interior side of the support member touches a base portion of the pony tail.

3. A method of claim 1 where the user's hair is radially positioned around the exterior surface of the support member.

4. A method of claim 1 where the user's hair that wrapped around the exterior surface of the support member is secured between the securing member and a base of the pony tail.

5. A method of claim 1 where the user's hair that wrapped around the exterior surface of the support member is secured between the securing member and the support member.

6. A method of claim 1 further comprising the step of tucking tips of the user's hair under the support member.

7. A method of claim 1 further comprising the step of rolling material in the shape of a cylinder upon itself thereby forming a support member having an aperture.

8. A method of claim 7 wherein the material comprises nylon.

* * * * *